US005400709A

United States Patent [19]

Drilling et al.

[11] Patent Number: 5,400,709

[45] Date of Patent: Mar. 28, 1995

[54] ROTARY PRINT HEAD MODULE AND IMPRESSION BAR

[75] Inventors: Joseph C. Drilling, Milford, Ohio; George W. Reinke, Reno, Nev.; Michael H. Schultz, Cincinnati, Ohio; Dilip Shah, Cincinnati; Douglas N. Woodruff, Cincinnati, Ohio

[73] Assignee: Comco Machinery, Inc., Milford, Ohio

[21] Appl. No.: 947,929

[22] Filed: Sep. 21, 1992

[51] Int. Cl.[6] ..... B41F 15/10; B41F 15/34

[52] U.S. Cl. ..... 101/115; 101/128.1

[58] Field of Search ..... 101/115, 116, 117–120, 101/183, 184, 185, 178–180, DIG. 49, 407.1, 128.1, 127.1

[56] References Cited

U.S. PATENT DOCUMENTS

| | | | |
|---|---|---|---|
| 1,977,812 | 10/1934 | Swift, Jr. | 101/183 X |
| 2,012,245 | 8/1935 | Meisel | 101/178 |
| 2,557,381 | 6/1951 | Huebner | 101/180 |
| 3,675,571 | 7/1972 | Vertegaal . | |
| 3,886,861 | 6/1975 | Anselrode . | |
| 3,994,220 | 11/1976 | Vertegaal . | |
| 4,117,779 | 10/1978 | Vertegaal . | |
| 4,217,821 | 8/1980 | Vertegaal et al. . | |
| 4,299,164 | 11/1981 | Jonkers . | |
| 4,366,542 | 12/1982 | Anselrode . | |
| 4,384,521 | 5/1983 | Muselaers . | |
| 4,413,541 | 11/1983 | Biggar, III . | |
| 4,449,450 | 5/1984 | Barny et al. . | |
| 4,462,311 | 7/1984 | Armelin . | |
| 4,887,529 | 12/1989 | Ichikawa et al. . | |
| 4,909,143 | 5/1990 | Van den Berg et al. . | |
| 5,060,569 | 10/1991 | Gladow . | |
| 5,213,033 | 5/1993 | Bourgeois et al. | 101/116 |

*Primary Examiner*—J. Reed Fisher
*Attorney, Agent, or Firm*—Wood, Herron & Evans

[57] ABSTRACT

A portable print head module dedicated to one type of printing, for example rotary screen printing, for functionally replacing one print head, dedicated to another type of printing, for example flexographic printing, in a rotary printing press having a number of spaced apart print head stations for transferring multiple images along the length of a continuous web substrate. The rotary print head module is installed by partially retrofitting one of the print head stations. The module can be moved to functionally replace any of the print heads in the rotary printing press. A non-rotating impression bar can be used to back the continuous web instead of a rotatable impression cylinder. A cushion of air is formed on the backing face of the impression bar on which the continuous web can ride.

35 Claims, 10 Drawing Sheets

137
138
139
140
141
142
146
147
148
149
150
151
152
156
157
158
35
135
132
121
8
10

ROTARY PRINT HEAD MODULE AND IMPRESSION BAR

FIELD OF THE INVENTION

This invention generally relates to rotary printing presses for processing continuous webs, more particularly, to rotary printing presses having a number of spaced apart print head stations, and even more particularly, to a rotary print head module for functionally replacing any one of the existing print heads in such a multi-station rotary printing press.

BACKGROUND OF THE INVENTION

In general, there appears to be an ever increasing demand placed on the continuous web printing press industry to supply more versatile rotary printing presses having multiple print head stations. The stations in these printing presses are often in a spaced apart and fixed relation to one another. One problem with present rotary printing presses having multiple print head stations is that each station is dedicated to a particular type of printing, for example, flexographic printing, rotary screen printing, offset printing, etc. It is often desirable with such a multiple station printing press, for example, a flexographic printing press, to have a non-flexographic printing operation performed at one or more of the printing press stations.

There are multiple station rotary printing presses presently available today which utilize a combination of printing operations, for example, flexographic and rotary screen. However, each station is still dedicated to only one type of printing. It is often desirable to vary, from one printing job to another, the sequence in which the different types of printing are performed. However, the time, effort, and expense involved in rededicating one or more of the print head stations of such printing presses has often been, heretofore, cost prohibitive.

SUMMARY OF THE INVENTION

In accordance with the present invention, a portable print head module dedicated to one type of printing, is provided for functionally replacing one print head, dedicated to another type of printing, in a rotary printing press having a number of spaced apart print head stations for transferring multiple images along the length of a continuous web substrate. The present invention is also directed to such a rotary print head module which can be quickly and easily installed in the rotary printing press by partially retrofitting one of the print head stations. More particularly, the present invention is directed to such a rotary print head module which can be moved to functionally replace any of the print heads in the rotary printing press.

The rotary print head module according to the present invention has a modular housing which is mountable adjacent to one of the print head stations of the rotary printing press. A rotatable printing mechanism is carried by the modular housing for transferring an image onto the continuous web as the printing mechanism rotates. A transferable image forming fluid, such as ink, is supplied to the printing mechanism. An impression mechanism is also carried by the modular housing. The impression mechanism has a backing face for backing (i.e., supporting) the continuous web while an image is transferred onto the web by the printing mechanism. The continuous web is directed along a path passing through the modular housing and between the printing mechanism and impression mechanism. The relative positions of the printing and impression mechanisms are adjustable such that the backing face provides support for the continuous web while an image is transferred thereon. The rotary print head module also has a gear system carried by the modular housing which includes at least one gear for rotationally driving the printing mechanism. The print head in the rotary printing press to be partially retrofitted has its own gear train. The gear system of the print head module is drivingly connected to the gear train of the functionally replaced print head. An intermediate gear box may be used to interconnect the gear system of the print head module and the gear train of the printing press print head.

In a preferred embodiment of this invention, the print head module is dedicated to a rotary screen type printing. This rotary screen print head module is used to functionally replace one of the print heads in a flexographic printing press having a number of spaced apart flexographic print head stations. While the print head stations are spaced apart, they are still fixed relative to one another. During the development of this preferred print head module of the present invention, a number of problems often encountered with rotary screen printing presses were overcome. One significant problem is the relatively poor image quality obtained when prior rotary screen print heads are operated at relatively high speeds. The preferred embodiment of the present rotary screen print head module incorporates most, if not all, of these improvements.

In rotary screen printing, a rotating tubular stencil or screen is used to transfer the ink image to the web. In the present invention, a non-rotating impression bar is used to back the web instead of an impression cylinder. A cushion of air is formed on the backing face of the impression bar on which the continuous web can ride. Normally, an impression cylinder is used for backing the continuous web in a rotary screen printing press. However, use of such a non-rotating impression bar has been found to have a significant affect on enabling the rotary screen printing to be performed at much higher web speeds than previously thought possible.

When an impression cylinder is used, its backing face is very narrow, thus there is a thin line of contact (i.e., a tangent line) between the tubular stencil and the impression cylinder, as transmitted through the web. A squeegee blade is mounted radially with a leading or contact edge against the inside surface of the stencil to squeegee off excess ink from the stencil before the image is transferred. In order to maintain the quality of the image transferred onto the web, during printing, the leading edge of the squeegee blade is positioned to contact the inside surface of the stencil adjacent to this line of contact. Because the line of contact is so narrow, it can become difficult if not impossible at times to maintain this relative position of the squeegee blade. At higher printing speeds, the squeegee blade is more likely to deflect or flex. When the squeegee deflects or flexes, it moves away from the line of contact resulting in smeared images transferred onto the web (i.e., a trailing edge problem). One way to eliminate this problem is by reducing the operating speed of the printing press. However, this reduces its efficiency. By using a non-rotating impression bar, the line of contact can be broadened because the backing face is broader. With a broader line of contact, the leading edge of the squeegee blade is more likely to remain sufficiently adjacent to the line of contact to maintain the quality of the image transferred to the web, even when the squeegee blade has deflected or flexed at higher operating speeds.

Modifying the profile of the squeegee blade has also been found to help maintain image quality at higher operating speeds. For a squeegee blade made from a polymeric material, such as polyurethane with a 70 durameter, the profile of the squeegee blade was changed from a single bevel formed on the underside of the leading edge to a profile having two bevels, one formed above and one below the leading edge. The squeegee blade thickness was kept the same. The single bevel used on earlier squeegee blades formed an angle of approximately 60° from the surface of the leading edge. The double bevel profile of the present squeegee blade is symmetrical, with each bevel formed at an angle of about 25° from the leading edge. Squeegee blades with the present profile have been found to be more resistant to deflecting or flexing at higher web speeds. Thus, the preferred embodiment of the present rotary screen print head utilizes a squeegee blade with the double bevel profile, as well as the non-rotating impression bar.

A contributing cause of the trailing edge problem (i.e., the transferred image smearing) has been found to be the way the ink is sheared by the relative movement between the leading edge of the squeegee blade and the inside surface of the stencil as the stencil rotates. With the central longitudinal axis of the squeegee blade being parallel to the central axis of the line of contact between the stencil and the impression mechanism, whether a bar or cylinder, the ink is sheared with a chisel cutting action. This chisel action is believed to contribute to the smearing of the transferred image at higher operating speeds. It has been found that skewing the central axis of the squeegee blade relative to the central axis of the line of contact (i.e., an axial line on the stencil) helps to enable the printing press to operate at higher speeds. It is believed that by skewing the squeegee blade the ink is now sheared by a slicing action which cuts the ink cleaner than the previous chisel action, thereby helping to maintain the quality of the transferred image at higher operating speeds. The skew of the squeegee blade is sufficiently slight to retain the advantages of using the impression bar (i.e., broad line of contact) while the blade still cuts the ink with the slicing action.

The ink image is transferred onto a web in rotary screen printing are typically cured with ultra-violet light. There has been a chronic problem with these images developing roughened surface textures, also referred to as orange peeling. It has been found that these ultra-violet cured inks need more time than what was previously allowed for the surface of the transferred ink image to smooth out before being cured. Moving the ultra-violet lights further away from the image transfer sight (i.e., the screen cylinder) was found to help significantly reduce orange peeling and enable the web speed to be increased.

The printing mechanism of the screen print head module includes a screen cylinder having the tubular stencil with flanged end rings and the squeegee blade mounted along its length radially against the inside surface of the stencil. Ink is supplied to the interior of the tubular stencil by an automatic ink dispenser which is capable of sensing the amount of ink available. The dispenser automatically maintains a supply of ink for printing throughout the printing press run. The stencil and squeegee blade could be damaged if a sufficient amount of ink is not supplied during a printing run.

The screen cylinder is held within the modular housing at each end of the flanged end rings by a retaining mechanism. Each retaining mechanism has a quick release feature and the modular housing is open at the top to facilitate insertion and removal of the screen cylinder, thereby reducing down time of the printing press when the screen cylinder is replaced.

In rotary screen printing, it is important for the stencil to remain under tension during printing. If the tension applied is too low, wrinkles can form in the stencil which are not only likely to adversely affect the quality of the image printed, but could also cause premature mechanical failure of the stencil. On the other hand, applying too much tension could also cause premature mechanical failure if the tension applied is greater than the strength of the stencil or the bond between the stencil and the flanged end rings. Stencils have been tensioned by mechanical springs or air cylinder mechanisms which applied a fixed load to the stencil. However, because of structural differences between screen cylinders, even those of the same size, these fixed load mechanisms are likely to apply too much or too little tension to the stencil. The present screen print head module utilizes an adjustable screen tensioning mechanism to apply varying tension loads to the stencil. With this mechanism the actual tension applied to the stencil can be measured and the optimum tension applied to each screen cylinder used. The applied tension can even be monitored and adjusted during a printing run.

It is believed that the use of a nonrotating impression bar has applications and advantages applicable to rotary printing presses in general. One problem encountered in many rotary printing presses is referred to as baring. Baring produces an undesirable appearance to the printed image. It is believed that by eliminating the impression cylinder roller, for example, in flexographic printing presses, baring would be reduced.

The above and other objectives, features and advantages of the present invention will become apparent upon consideration of the following descriptions taken in conjunction with the accompanying drawings.

DETAILED DESCRIPTION OF THE INVENTION

Figure 1:
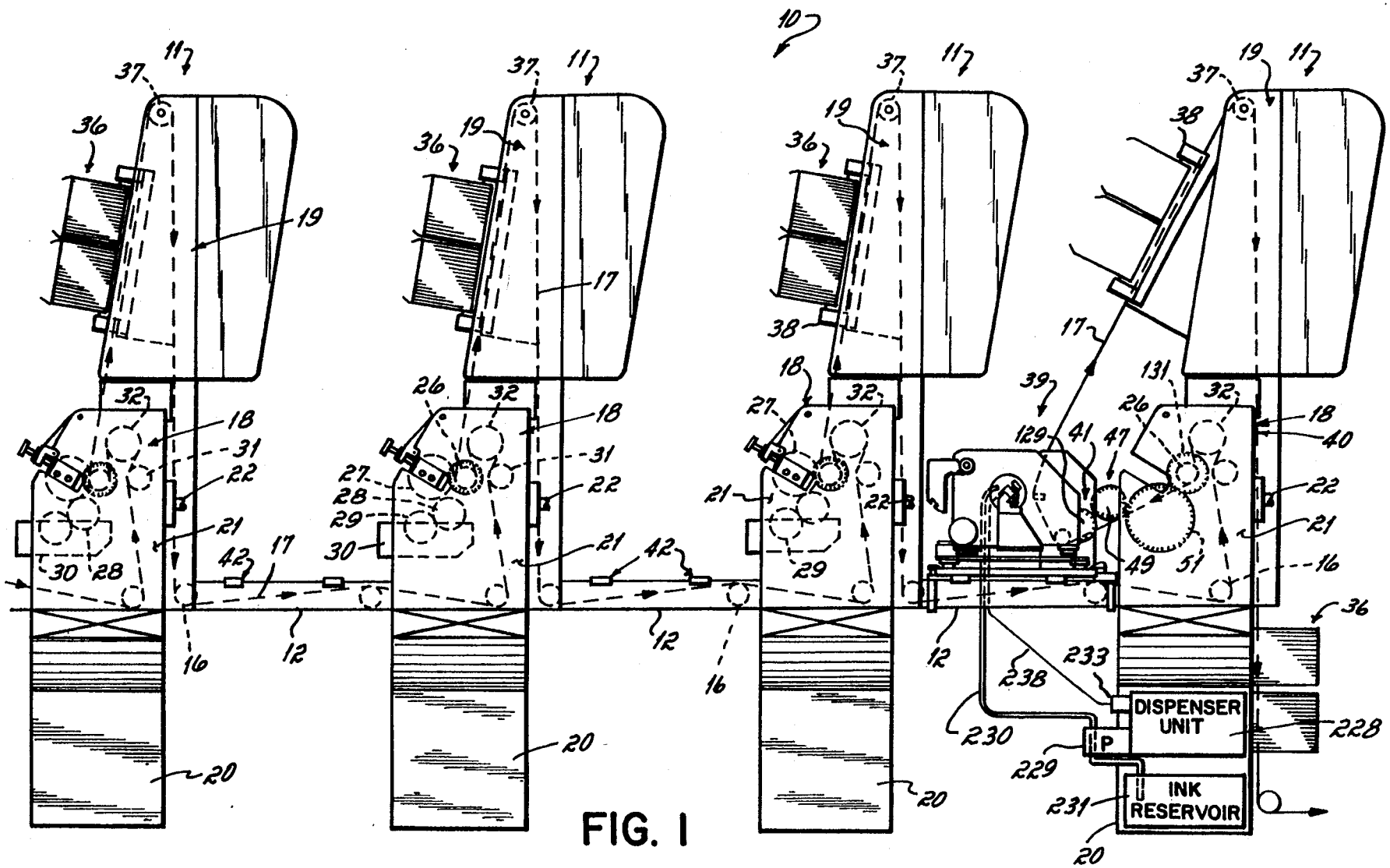
FIG. 1 is a diagrammatic operator side view of a multi-station flexographic printing press, as seen by a press operator, having a rotary screen print head module of this invention installed between a pair of fixed flexographic print head stations.

The present invention is applicable to a variety of rotary printing presses having multiple print head stations, including flexographic, screen, offset, etc. For the purposes of this description, a narrow web multi-color rotary flexographic printing press 10 is shown in FIG. 1. The flexographic printing press 10 has multiple flexographic print head stations 11, with one color image being printed at each station. These stations 11 are spaced apart in a row and fixed in place by two generally parallel and horizontal tie bars 12 mounted one on either side of the press 10. Two longitudinally spaced idler rollers 16 carry a continuous web substrate 17 between each pair of adjacent stations 11.

Each flexographic station 11 includes a flexographic print head 18, a curing tower 19, and a base 20. The flexographic print head 18 includes a frame having an operator side panel 21 and a gear train side panel 48 on either side of the web 17. Each print head 18 has its own gear train (not shown). A station to station line shaft 22 interconnects and powers the gear train (not shown) to each print head 18. Each print head 18 includes an impression cylinder roller 26, a printing plate roller 27, an anilox roller 28 and some type of inking mechanism for applying ink to the anilox roller 28, such as a metering roller 29 and an ink pan 30.

The substrate web 17 travels from station to station, generally carried by a plurality of idler rollers 16. The web 17 enters the bottom of each print head 18, follows a path upward toward a registration shaft 3 1 and up and over a pull roller 32 and under and around the impression roller 26 in a general S-wrap. While being carried and backed by the impression roller 26, a single color image (not shown) is transferred from the printing plate roller 27 to the web 17. The web 17 exits the top of the print head 18 and enters the bottom of the curing tower 19 and travels up past a curing device, such as an ultra-violet light source 36, for curing the inked image. The web 17 then travels up, over and around an idler roller 37 at the top of the curing tower 19 and travels down toward another idler roller 16 leading to the next station 11. The ultra-violet light source 36 is mounted in a frame 38 which is pivotable about the central axis of the idler roller 37, in a direction back toward the inlet end of the printing press 10.

For each existing flexographic print head 18, the line shaft 22 is operatively connected to the impression roller 26 for driving the gear train of the print head 18. A harmonic gear (not shown) like that shown in U.S. Patent No. 3,724,368 which is incorporated by reference herein in its entirety, is incorporated within the gear train of each print head 18 to effect phase changes of the printing plate roller 27 with respect to the impression roller 26 for circumferential registration control of the printed images.

A narrow web rotary screen print head module 39, according to a preferred embodiment of the present invention, is designed to be inserted upline from and adjacent to one of the stations 11. This invention is also applicable to the rotary screen printing of larger webs, as well as non-modular rotary screen print head applications. The screen print head includes a screen cylinder 35 with a squeegee blade 43 located inside the screen cylinder 35 and a non-rotating impression bar 44 located on the outside of the screen cylinder 35. The module 39 changes the flexographic printing operation performed by a downline flexographic print head 40 to a rotary screen printing operation. In order to avoid the problem of orange peeling, i.e., surface roughening of the transferred ink image, the ultra-violet curing lights 36 of the print head 40 have been moved to a remote location adjacent the station base 20. As the web speed increases the lights 36 have to be moved further away to ensure curing without orange peeling. The module 39 has a gear system 41 which is connected to and driven by the gear train (not shown) of the downline print head 40. In this way, the module 39 can be located upline from and functionally replace any dedicated flexographic print head 18 desired.

Figure 2:
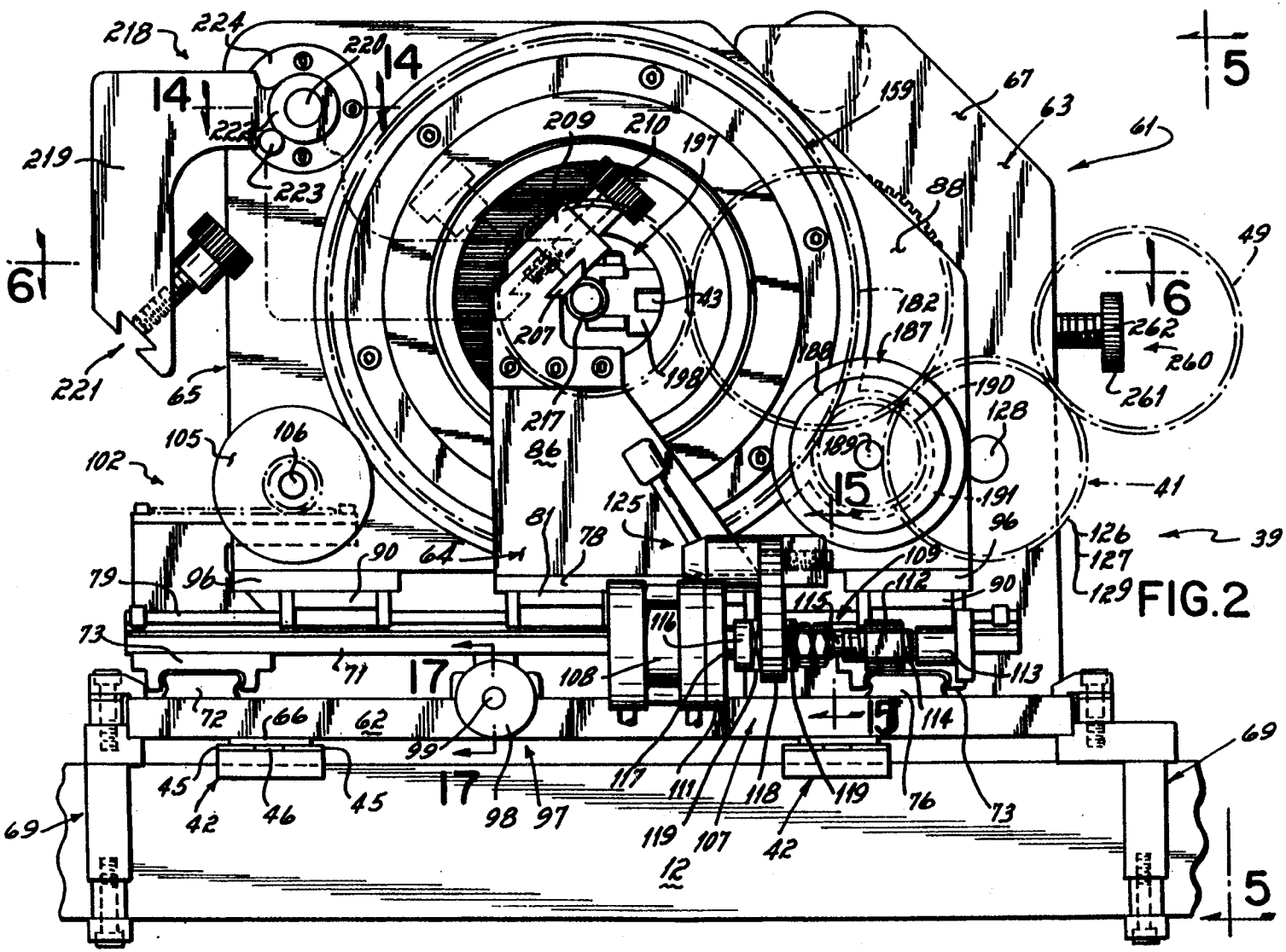
FIG. 2 is an enlarged diagrammatic operator side view of the print head module of this invention.

Before inserting the screen module at a desired printing position, a pair of cross rails 42 are longitudinally spaced and mounted across the tie bars 12. As shown in FIG. 2, a strip 46 of ultra high molecular weight (i.e., UHMW) plastic bearing material, preferably polyethylene, is centrally located along the length of each cross rail 42. The bearing strip 46 is supported on either side by metal retaining strips 45, all of which are bolted in place.

Figure 4:
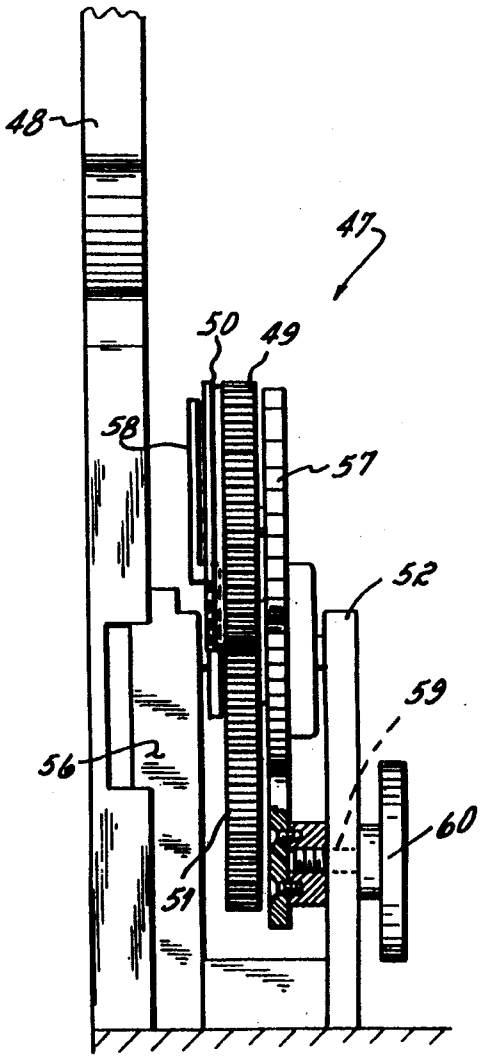
FIG. 4 is an elevational view as seen along line 4—4 of FIG. 3.
Figure 3:
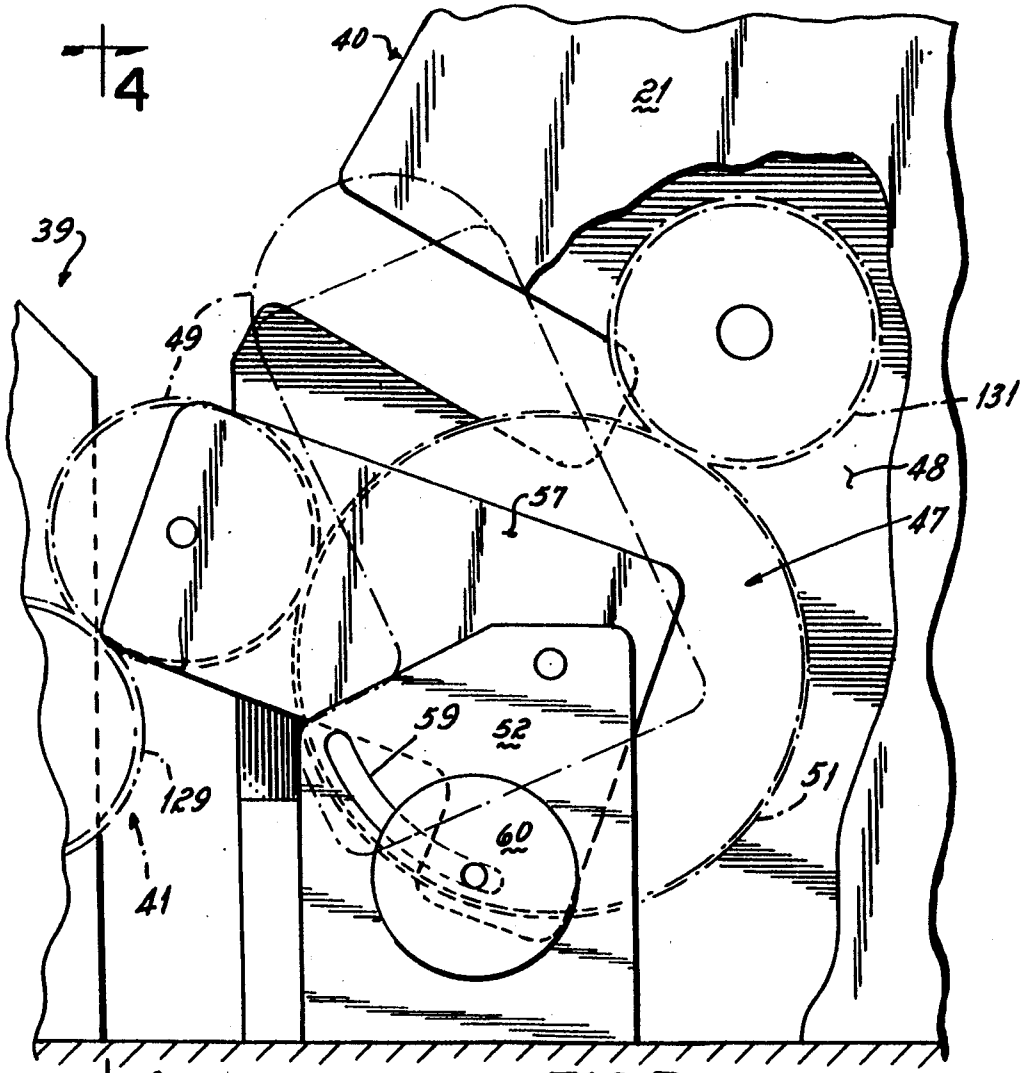
FIG. 3 is an enlarged diagrammatic side view of a swing gear utilized to interconnect a gear system of the print head module of this invention with the gear train of a flexographic print head station.

The printing plate roller 27, anilox roller 28, metering roller 29 and ink pan 30 are removed from the flexographic print head 40 before the module 39 is installed in order to make room for an intermediate gear box 47. Referring to FIGS. 3 and 4, the separate gear box 47, which is transferable from one existing flexographic print head 18 to another, is mounted against the gear train side panel 48 of the flexographic print head 40. The gear box 47 has a planetary gear 49, with a bearer ring 50 integral therewith, rotatable about an idler gear 51. The idler gear 51 is supported by two support plates 52, 56, with the gear train side idler gear support plate 56 being adapted to be received by and mounted to the inner surface of the gear side panel 48 of the print head 40. The idler gear 51 is mounted to the support plates 52, 56 for rotation about its central axis. The planetary gear 49 is mounted for rotation about the central axis of the idler gear 51 between two support plates 57, 58 located inside of the idler gear support plates 52, 56. The operator side support plate 52 has a planetary gear positioning slot 59 formed therethrough and a position locking screw 60. The planetary gear 49 is positioned by unlocking and rotating the position locking screw 60 along the positioning slot 59, moving the planetary gear 49 from a disengaged position (shown in phantom) to an engaged position (see FIG. 3). The gear box or swing gear assembly 47 interconnects the gear train (now shown) of the flexographic print head 40, through engagement with an impression cylinder drive gear 131, to the gear system 41 of the print head module 39.

Figure 5:
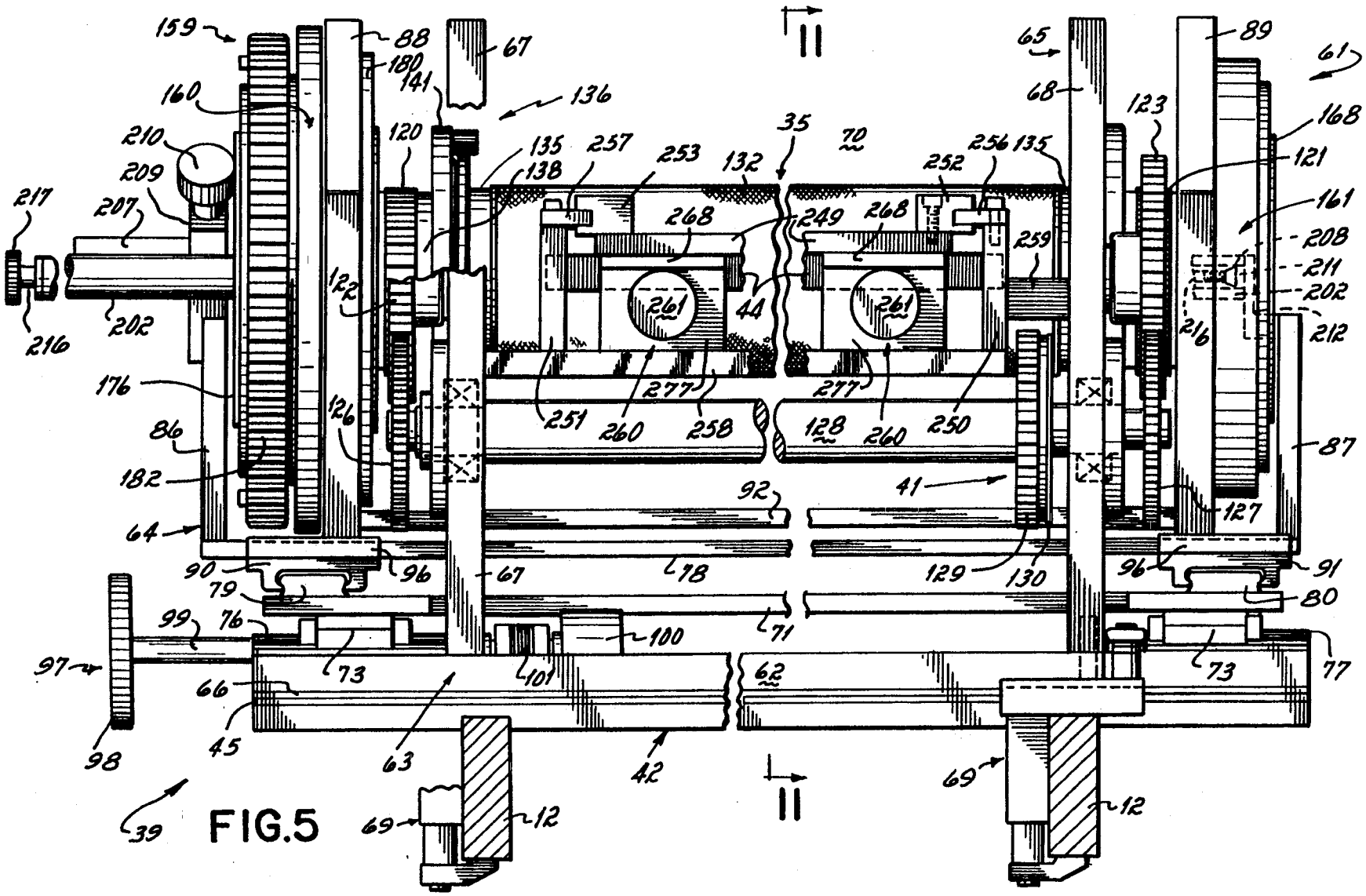
FIG. 5 an elevational, partly broken away view of the downline end of the print head module as seen along line 5—5 of FIG. 2.

Referring mainly to FIGS. 2 and 5, the print head module 39 has a housing 61 which has three interconnected frames 63, 64, and 65 for mounting the impression 44, the squeegee blade 43, and the screen cylinder 35, respectively. The first frame 63 includes a fixed bottom base plate 62 with a pair of spacer sliding strips 66 mounted laterally thereunder. The spacer sliding strips 66 are made of steel with a polished surface for sliding onto the cross rails 42. The module 39 is held in place above the cross rails 42 by fixing the bottom base plate 62 to the tie bars 12 with four clamps 69, one at each corner. Two spaced apart fixed vertical panels 67, 68 are bolted to the bottom base plate 62, one on either side of the web path 70. The impression bar 44 is suspended between the fixed vertical panels 67, 68.

The second frame 64 includes a middle bearing plate 71 which is mounted above the fixed bottom base plate 62 by three linear bearings rails 72, 76, 77 which enable the middle bearing plate 71, having four bearing blocks 73 mounted on its lower on its lower surface, to move from side to side across the fixed bottom base plate 62. One linear bearing 72 runs across the upline end of the bottom base plate 62 and the other two linear bearings rails 76, 77 are on the other end and run from respective fixed panels 67, 68 laterally outward. A squeegee support cross plate 78 is mounted for longitudinal sliding above the middle bearing plate 71. The middle bearing plate 71 has on its upper surface two spaced apart linear bearing rails 79, 80 running lengthwise thereon, each positioned laterally outside respective fixed panels 67, 68. The squeegee cross plate 78 is moveable longitudinally along the bearing rails 79, 80 by respective sets of end to end bearing blocks 81, 82. Two squeegee support plates 86, 87 are mounted to the squeegee cross plate 78 on the lateral side of the fixed panels 67, 68, respectively. The squeegee blade 43 is suspended between the support plates 86, 87. The squeegee support plate 87 on the gear train side is jogged medially to avoid the line shaft 22 of the printing press 10.

The third frame 65 includes two spaced apart moving vertical panels 88, 89 which are also slidably mounted to the bearing rails 79, 80, by two pairs of bearing blocks 90, 91, respectively. A moving panel cross plate 92 is mounted between the moving vertical panels 88, 89 to maintain their spaced apart relation. Spacer pads 96 are used to raise the moving vertical panels 88, 89 and moving panel cross plate 92 above the squeegee cross plate 78. The moving vertical panels 88, 89 are mounted through these pads 96 to their respective bearing blocks 90, 91. The screen cylinder 35 is suspended between the vertical panels 88, 89.

Figure 15:
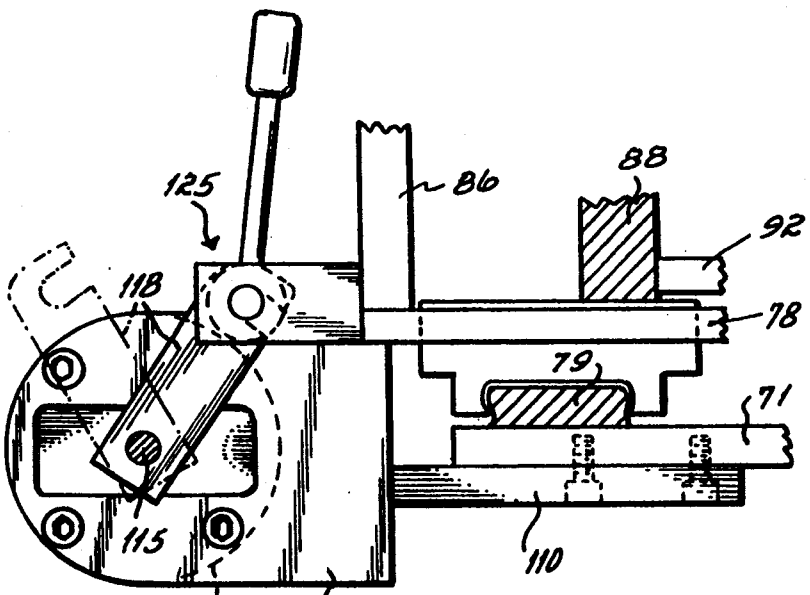
FIG. 15 is a diagrammatic view as seen on line 15—15 of FIG. 2 illustrating the locking structure for the squeegee adjustment mechanism.
Figure 17:
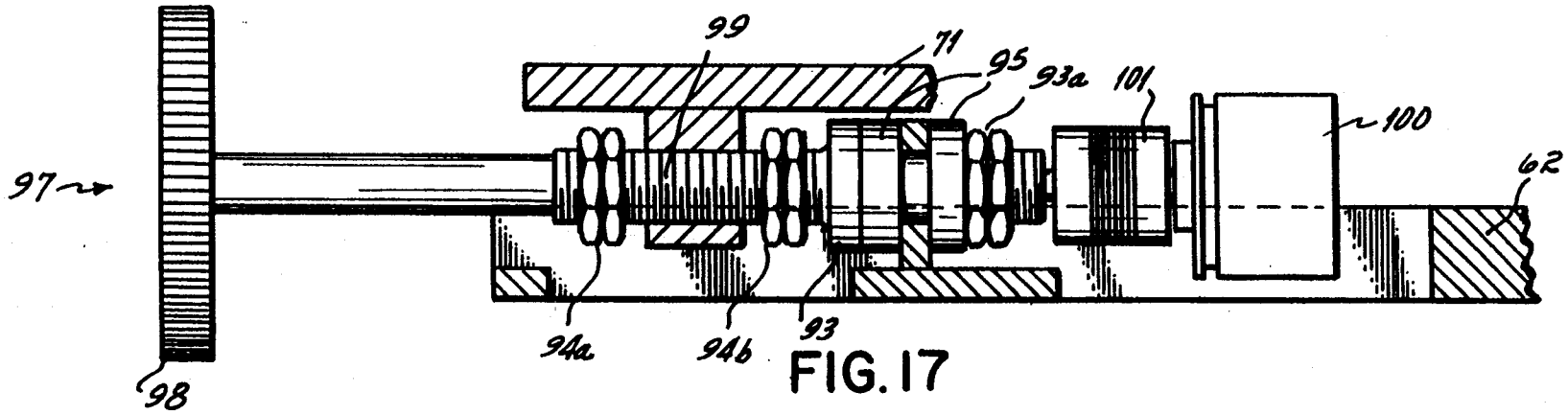
FIG. 17 is a diagrammatic view taken along the line 17—17 of FIG. 2 illustrating the lateral registration adjustment mechanism.
Figure 18:
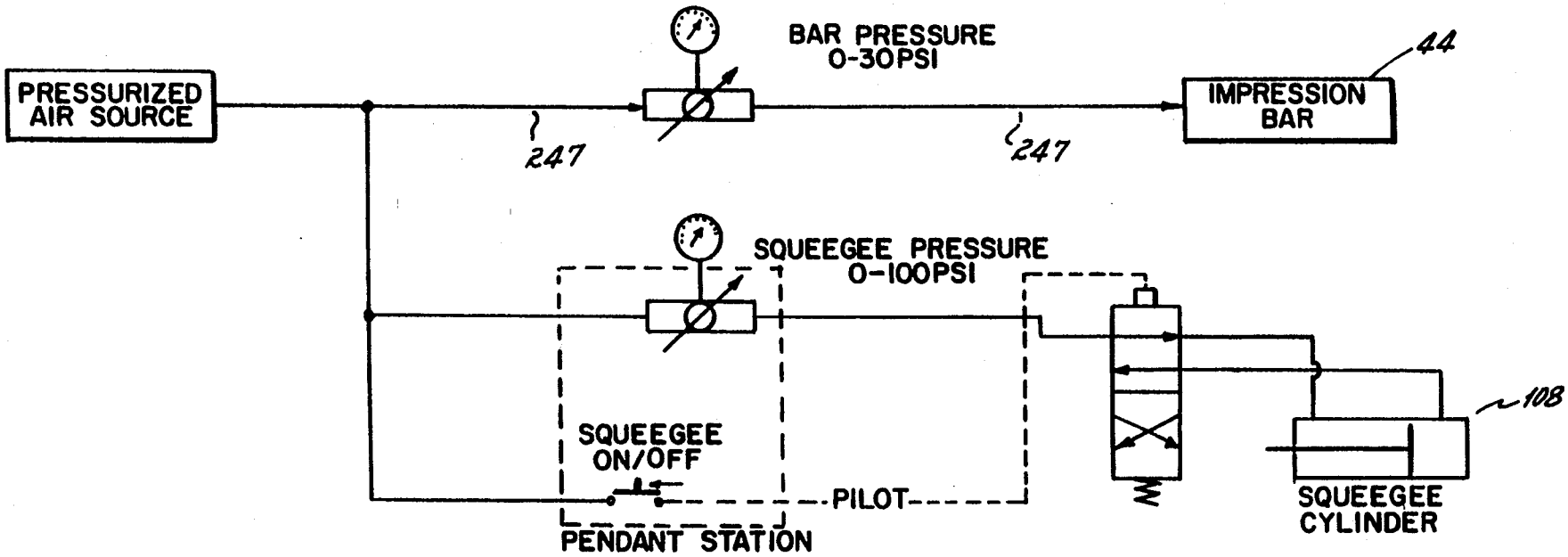
FIG. 18 is a diagram of the air pressure control system for both the impression bar and the double action air cylinder of the squeegee position adjustment mechanism.

Lateral movement of the middle bearing plate 71 is controlled by a micrometer adjustment mechanism 97. Referring to FIG. 17, the lateral adjustment mechanism 97 includes a manual adjustment knob 98 on the end of a threaded shaft 99 rigidly secured to the bottom base plate 62 by a pair of thrust bearings 95 sandwiched between a flange 93 on the shaft 99 and jam nuts **93*a*. The shaft 99 is threadably mounted to the middle bearing plate 71 with limiting jam nuts 94*a* and 94*b* for limiting the lateral movement of the metal bearing plate 71. An encoder 100 mounted to the end of the threaded shaft 99 by a flexible coupling 101 is connected to a digital counter (not shown) for indicating the lateral position of the middle bearing plate 71. Dual rack and pinion gear assemblies 102 mounted on a shaft 106 are located between the two moving vertical panels 88, 89 for controlling the longitudinal movement of the moving vertical panels 88, 89 and cross plate 92 along the bearing rails 79, 80 (see FIG. 11). A knob 105 is used to manipulate the assemblies 102. The squeegee support plates 86, 87 are moveable along the longitudinal bearing rails 79, 80 by a squeegee position adjustment mechanism 107 mounted to the middle bearing plate 71 (see FIG. 15). The squeegee adjustment mechanism 107 includes a dual piston, double acting air cylinder 108 for moving the squeegee support plates 86, 87 within a defined throw length, i.e., air cylinder stroke. The air pressure control system for the air cylinder 108 is shown in FIG. 18. The preferred air cylinder 108 is manufactured by Bimba Manufacturing Co., Munee, Ill., Model No. FT-17-.500-3-LE. The stroke of the air cylinder 108 is adjusted by a threaded adjustable stop mechanism 109. Referring to FIG. 15, the squeegee adjustment mechanism 107 is :mounted to the middle bearing plate 71 by a mounting bracket 110**.

The air cylinder 108 is mounted to the bracket 110 by an integral plate 111. The adjustable stop mechanism 109 is mounted to the bracket 110 by a stop block 112. The adjustable stop mechanism 109 includes a knob 113 mounting a threaded shaft 114, preferably having 40 pitch threads. The threaded shaft 114 is received by a threaded hole formed in the stop block 112. The end of the shaft 114 is counter bored for slidably receiving one end of an air cylinder stroke shaft 115. The other end of the stroke shaft 115 is welded to a plate 116 mounted to the ends of dual piston rods 117 from the air cylinder 108. The rods 117 slide through holes in the air cylinder mounting plate 111. A hooking arm 118 is held in position for rotation about the stroke shaft 115 by a pair of captured thrust bearings 119. The hooking arm 118 has a hooked end for engaging a hook locking nut assembly 125 mounted to the squeegee cross plate 78 and support plate 86. The stroke length of the air cylinder 108 is controlled by adjusting the position of the threaded shaft 114 with respect to the stop block 112 (i.e., by turning the knob 113). In this way, the range of motion of the squeegee blade 43 with respect to the inside surface of the stencil 132 can be adjusted, and in turn, the pressure applied by the squeegee blade 43 on the stencil 132.

Figure 6:
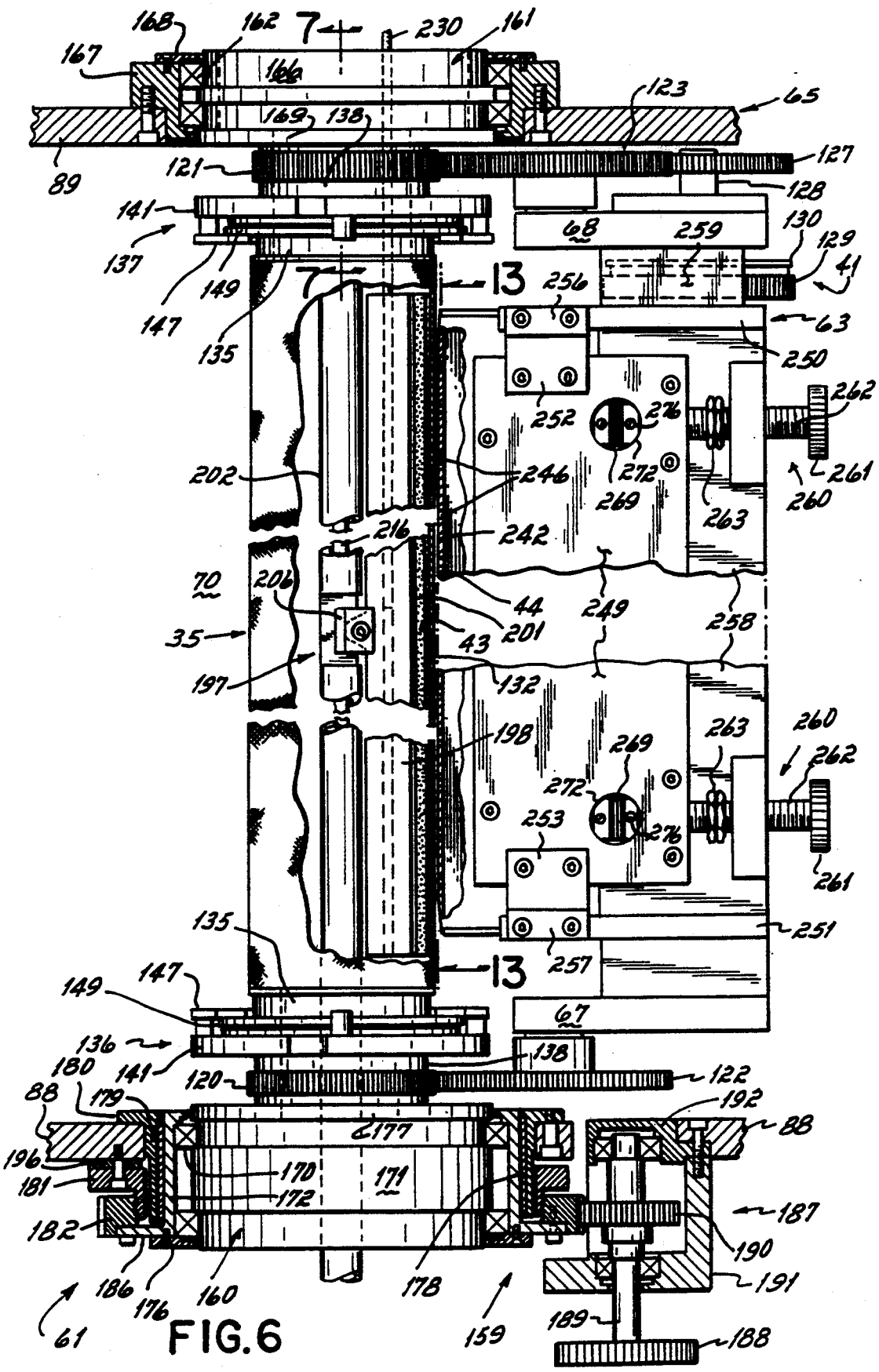
FIG. 6 is a cross-sectional view, partly broken away, taken along the line 6—6 of FIG. 2.

Referring to FIGS. 5 and 6, two driven gears 120, 121, one for driving each end of the screen cylinder 35, are rotatably mounted to the moving vertical panels 88, 89. The pitch diameter of the screen gears 120, 121 should equal the outside diameter of the screen cylinder 35 (i.e., its repeat length). The screen gears 120, 121 are engagable with a pair of idler gears 122, 123 by adjusting the rack and pinion assemblies 102. The idler gears 122, 123 are individually mounted to the lateral side of the fixed vertical panels 67, 68, respectively, and are in continuous engagement with respective end gears 126, 127 of a free rotating jack shaft 128 mounted through the fixed vertical panels 67, 68. The idler gears 122, 123 are used between the screen cylinder gears 120, 121 and the jack shaft end gears 126, 127 so that the screen cylinder 35 rotates in the proper direction relative to the web movement. Each set of screen gears 120, 121, idler gears 122, 123, and jack shaft end gears 126, 127 are located between respective fixed vertical panels 67, 68 and moving vertical panels 88, 89. A main drive gear 129 with a bearer ring 130 integral therewith is mounted to the jack shaft 128 medially of the fixed vertical panel 68. As shown in FIGS. 2 and 3, the jack shaft main drive gear 129 is engagable with the gear train (i.e., the impression cylinder gear 131) of the flexographic print head 40 by the swing gear assembly 47.

By loosening the position locking knob 60, the planetary gear 49 can be rotated in and out of engagement of the jack shaft main drive gear 129 as desired. Once engagement has occurred, the position locking knob 60 is tightened to lock the planetary gear 49 in place. In positioning the screen print head module 39 onto the dual cross rails 42 spanning the tie bars 12, the jack shaft drive gear 129 should be lined up with the planetary gear 49 before the module 39 is clamped down to the tie bars 12 with the four clamps 69. With the gear system 41 of the module 39 properly engaged with the gear train of the flexographic print head 40 through the intermediate gear box 47, the registration control system (i.e., the harmonic gear train) of the partially retrofitted flexographic print head 40 can now be used to control the registration of, as well as the driving of the screen cylinder 35 relative to the movement of the web 17.

Figures 7, 8, 9, 10:
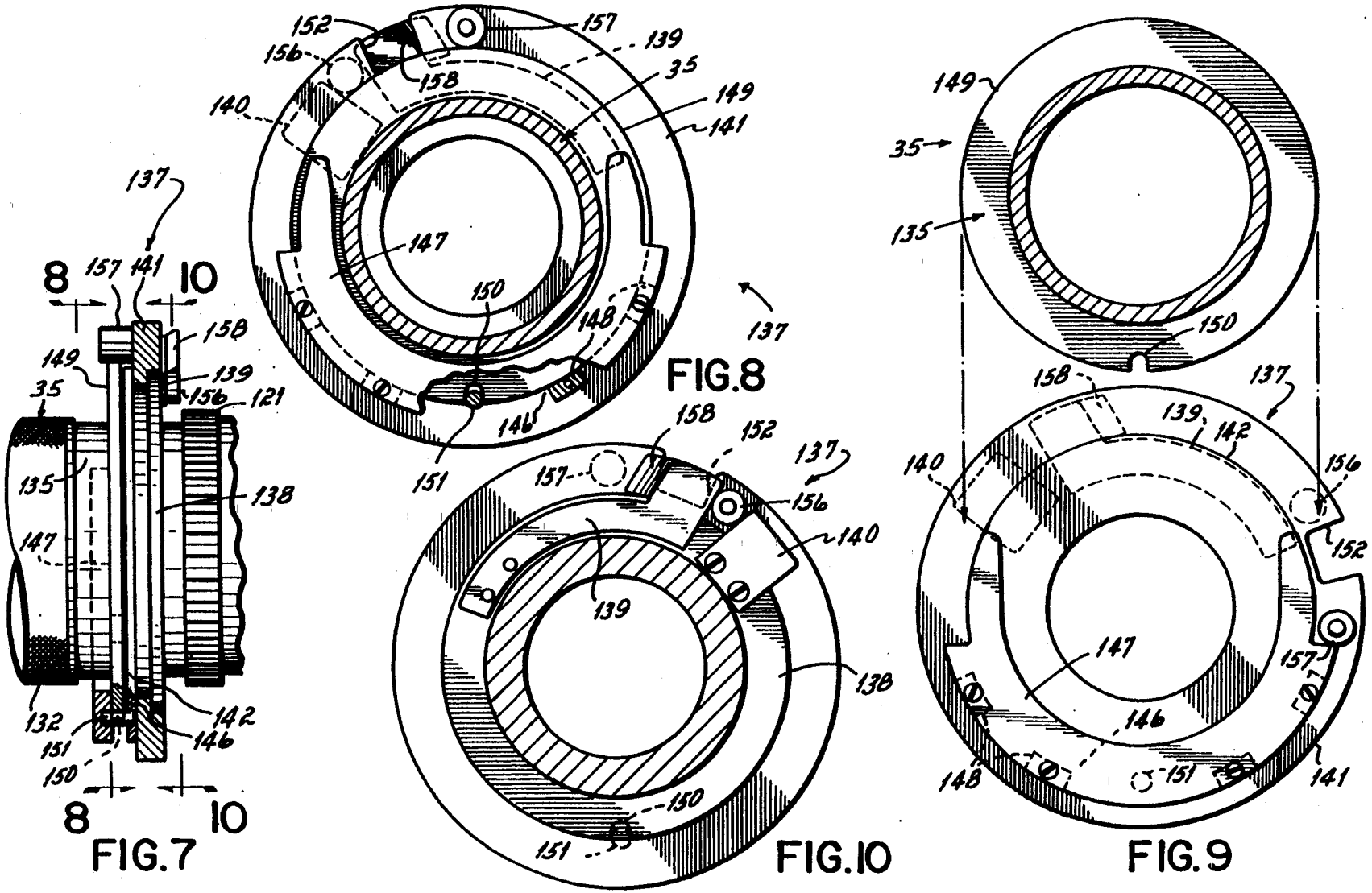
FIG. 7 is a diagrammatic cross-sectional view taken along the line 7—7 of FIG. 6.
FIG. 8 is a diagrammatic cross-sectional view taken along the line 8—8 of FIG. 7, illustrating the closed position of a screen cylinder retaining mechanism.
FIG. 9 is a view similar to FIG. 8, but illustrating an end ring of the screen cylinder removed and the retaining mechanism in an open position.
FIG. 10 is a diagrammatic cross-sectional view taken along the lines 10—10 of FIG. 7, the retaining mechanism being in a closed position.

Referring to FIGS. 7–10, the screen cylinder 35 has a tubular stencil 132 with a mounting ring 135 at each end. The end rings 135 are secured to the ends of the tubular stencil 132 by standard means, such as adhesive bonding. Two retaining mechanisms 136, 137 used to secure the ends of the screen cylinder 35 to the module 39 allow the screen cylinder 35 to be easily and quickly removed or inserted through the top of the module 39. The retaining mechanisms 136, 137 are generally mirror images of each other. Therefore, only one will be described in detail. The central axis of each retaining mechanism 136, 137 is concentric with the central axis of the screen cylinder 35 and the screen driving gears 120, 121. Each retaining mechanism 136, 137 includes a locking guide ring 138 made of steel which is mounted concentrically with its respective screen cylinder drive gear 120, 121. A spaced apart steel retaining leaf spring 139 and stationary lock stop 140 are fixed to the medial surface along the upper circumferential edge of the steel locking guide ring 138. A cam follower or rotatable locking ring 141 made of bearing brass is mounted between the guide ring 138 and a steel retaining ring 142. The retaining ring 142 and guide ring 138 are sufficiently spaced apart to allow easy rotation of the locking ring 141 about the central axis of the retaining mechanism 136. A retaining well 146, capable of receiving either end ring 135 of the screen cylinder 35, is formed in the retaining mechanism 136 by mounting a horseshoe shaped retaining lip 147 to spacer pads 148 on the lower circumferential edge of the retaining ring 142. Each end ring 135 of the screen cylinder 35 has a circumferential flange 149 with a locator notch 150 formed on the outer edge. A locator pin 151 is mounted in the retaining well 146 for engaging the locator notch 150 when the screen cylinder end ring 135 is mounted therein, thereby locking the screen cylinder 35 in place for being driven by gears 120, 121. The locking ring 141 has a spring disengagement window 152 formed along its outer circumferential edge. A lock stop 156 and a retaining stud 157 are mounted to the locking ring 141 on either side of the window 152, with the lock stop 156 being mounted on the same side as the retaining spring 139 and the retaining stud 157 being mounted on the same side as the retaining well 146. The locking ring 141 is rotatable between an unlocked and open position as shown in FIG. 9 and a locked and closed position as shown in FIGS. 7, 8, and 10. To close and lock the retaining mechanism 136, the locking ring 141 is rotated until the lock stop 156 moves past the retaining spring 139. The retaining stud 157 is simultaneously brought to a generally 12 o'clock position and the window 152 brought in line with the free end of the retaining spring 139. The retaining spring 139 has a ramped lip 158 which facilitates passage of the lock stop 156 past the spring 139 and into its locked position (see FIG. 10). The locking ring 141 is unlocked by applying a force through the window 152 to deflect the retaining spring 139 enough to allow the lock stop 156 to move past the spring 139.

Referring mainly to FIG. 6, a screen tensioning mechanism 159 is used to apply a variable tension load to the stencil 132 and to monitor and maintain that tension even during a print run. The screen tensioning mechanism 159 includes the dual retaining mechanisms 136, 137 which are concentrically interconnected through respective screen gears 120, 121 to an axially adjustable large bearing assembly 160 and a fixed large bearing assembly 161 mounted to respective moving vertical panels 88, 89. The fixed bearing assembly 161 includes a large diameter ring bearing 162 retained between an inner bearing cup 166 and an outer bearing cup 167 by a bearing retaining ring 168. An adapter disc 169 is mounted between the inner bearing cup 166 and the gear train side screen cylinder gear 121. The outer bearing cup 167 is bolted into an opening in the moving vertical panel 89. The axially adjustable large bearing assembly 160 includes a large diameter ring bearing 170 retained between an inner bearing cup 171 and an outer bearing cup 172 by a retaining ring 176. An adapter disc 177 interconnects the inner bearing cup 171 to the operator side screen cylinder gear 120. A brass bearing ring 178 is fixed to the outer surface of the outer bearing cup 172, preferably by heating the brass ring 178 to form a compression fit. A slip bearing housing 179 slidably carries the brass bearing ring 178. The bearing housing 179 has a circumferential flange 180 mounted to the medial side of the moving vertical panel 88 in order to secure the bearing housing 179 in an opening formed through the moving vertical panel 88. A threaded tensioning ring 181 is bolted in place to the lateral side of the moving vertical panel 88 around the outside of the bearing housing 179. A threaded tensioning ring gear 182 is mounted to a flange 186 on the outer bearing cup 172. The ring gear 182 is threadably engaged to the tensioning ring 181.

A tension adjustment assembly 187 engages the tensioning ring gear 182 for controlling the rotation of the tensioning ring gear 182 about the threaded portion of the tensioning ring 181 and thereby the axial movement of the ring gear 182. The tension adjustment assembly 187 includes a knob 188 mounted on the end of a shaft 189 having a tensioning pinion gear 190 mounted thereon which engages the tensioning ring gear 182. The tensioning pinion shaft 189 is carried by two sets of bearings captured in a housing 191 having a housing end cap 192. The housing 191 and end cap 192 are mounted to the lateral side of the moving vertical panel 88. A load cell 196 and two dummy cell spacers (not shown) are symmetrically positioned between the vertical panel 88 and the threaded tensioning ring 181. The load cell 196 is a voltage transducer sensitive to compressive loads applied axially thereon by the threaded tensioning ring 181. The load cell 196 is electrically connected to a volt meter with a digital readout (not shown) to allow the stencil tension to be constantly monitored. With both ends of the screen cylinder 35 locked in place in the retaining mechanisms 136, 137, axial movement of the tensioning ring gear 182 away from the gear train side of the module 39 will apply a tension to the stencil 132 of the screen cylinder 35. At the same time, a reactive force in the form of compression will be exerted on the tensioning ring 181 and, in turn, the load cell 196. Thus, an indirect measurement of the tension applied to the stencil 132 can be obtained. In addition, because of the incorporation of the bearing assemblies 160, 161, the tension applied to the stencil 132 can be adjusted even during a printing run.

Figure 16:
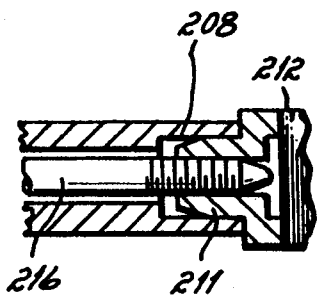
FIG. 16 is a diagrammatic cross-sectional view taken on the line 16—16 of FIG. 5 illustrating the structure for securing one end of the squeegee tube.

Referring mainly to FIGS. 2, 5, 6, and 12, a squeegee mounting mechanism 197 mounts the squeegee blade 43, having a leading edge 203, radially within the screen cylinder 35 for contacting the inside surface of the stencil 132 to squeegee off excess ink from the stencil 132 before the image is transferred. The preferred squeegee blade 43 is made from polyurethane, having a 70 durameter. The present squeegee blade 43 has a symmetrical double bevelled profile, with each bevel formed at an angle of about 25° from the leading edge 203. The squeegee mounting mechanism 197 includes a squeegee support beam 198 having a channel 199 formed along its length for receiving the squeegee blade 43. The squeegee blade 43 is held within the channel 199 by a plurality of set screws 200 positioned along the length of the squeegee support beam 198. Pressure from the set screws 200 is applied to the squeegee 43 through a clamping bar 201 sandwiched between the squeegee 43 and the channel 199 and running the length of the support beam 1988. The squeegee blade 43 is mounted at an angle, or skewed, from the central longitudinal axis of the backing face 242 of the impression bar 44 (i.e., the broad line of contact), see FIG. 13. A preferable method for accomplishing such a skewed squeegee blade 43 is by forming the channel 199 in the squeegee support beam 198 at the desired angle from the central axis of the squeegee tube. A skew angle for the squeegee blade 43 that has had satisfactory result is approximately 0.5°. Mounting the squeegee 43 at a point half way along its length appears to insure that the squeegee 43 will apply an equal pressure against the inside surface of the stencil 132 along its entire length. The squeegee support beam 198 is mounted to a squeegee tube 202 by a yoke 206 at a center point along the length of the squeegee support beam 198. The squeegee tube 202 has a dove tail bar 207 fixed at one end and a counter bore 208 at the other end (see FIG. 16). A squeegee tube clamp 209 mounted on top of the operator side squeegee support plate 86 is designed to grip the dove tail 207 and support that end of the squeegee tube 202. The dove tail 207 can be clamped or released by manipulating the screw 210 on the clamp 209. The other end of the squeegee tube 202 with the counter bore 208 is supported by the moveable squeegee support plate 87 on the gear train side of the module 39. The counter bore 208 receives the mating male end 211 of a flanged end nut 212 mounted to the top of the gear train side moveable squeegee support plate 87. This end of the squeegee tube 202 is secured to the flanged end nut 212 by a threaded rod 216 passing through the length of the squeegee tube 202. A knob 217 affixed to the end of the threaded rod 216 is used to thread the rod into the flanged end nut 212 and tighten the squeegee tube 202 in place.

Figure 14:
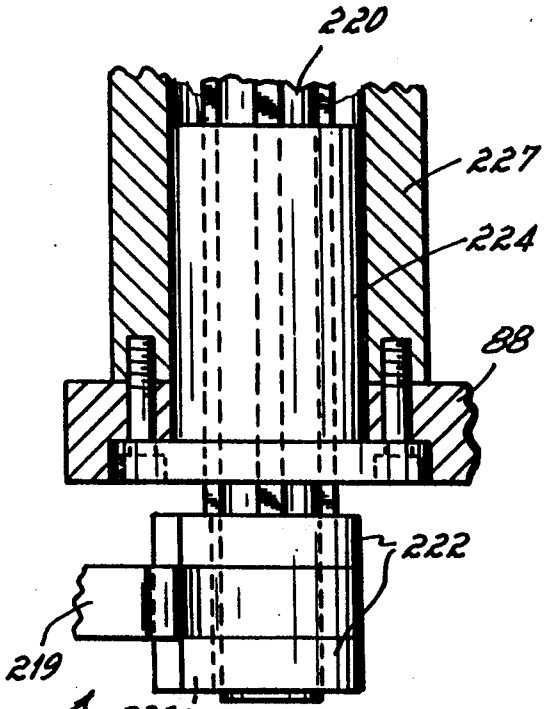
FIG. 14 is a diagrammatic cross-section view taken along the line 14—14 of FIG. 2 illustrating the squeegee loading mechanism for transversely moving the mounting shaft, and rotating the squeegee loading arm.

Referring to FIGS. 2 and 14, a squeegee loading mechanism 218 is used to help insert and remove the squeegee mounting mechanism 197 from inside the screen cylinder 35. The squeegee loading mechanism 218 includes a generally L-shaped squeegee loading arm 219 having a circular hole at one end for slidably rotating about a mounting shaft 220, and a dove tail clamp 221 formed in the other end for engagement with the dove tail 207 on the squeegee tube 202. Two ring clamps 222 are fixed to the mounting shaft 220, one clamp 222 adjacent either side of the loading arm 219. The mounting shaft 220 is splined to allow linear sliding along its axis, but to prevent rotation about its central axis. A stop bar 223 is fixed at either end to the ring clamps 222 for limiting the rotation of the loading arm 219 about the mounting shaft 220. The ring clamps 222 and stop bar 223 are oriented on the mounting shaft 220 such that the loading arm 219 rests against the stop bar 223 at a stand by position when the loading arm 219 is swung counterclockwise about the mounting shaft 220 and rests against the stop bar 223 at a loading position (shown in phantom in FIG. 9) when the loading arm 219 is swung clockwise about the mounting shaft 220. The mounting shaft 220 is slidably carried at either end by a flanged bearing insert 224 mounted in a hole formed through each of the moveable vertical panels 88, 89, respectively. The basic splined mounting shaft 220 and flanged bearing inserts 224 are commercially available as a unit from THK America, Inc., Elk Grove Village, Ill., model no. LBF25T. A steel tube 227 is mounted over the medially projecting ends of the bearing inserts 224 between the moving vertical panels 88, 89 with the same bolts used to mount each bearing insert 224. This tube 227 functions as an additional spacer for maintaining the distance between the moving vertical panels 88, 89 and also shields the mounting shaft 220 from printing ink being deposited and building up thereon.

Referring to FIGS. 1, 11, 12, and 12A, printing ink is supplied to the interior of the screen cylinder 35 by an automatic ink dispensing unit 228. The ink dispensing unit 228 includes a pump 229 which pumps ink through a hose 230 by externally manipulating the hose. The pump 229 provides a cam action to rub the hose 230, thereby pumping fluid through the hose. This type of pump 229 is commercially available and the preferred pump used in the present ink dispenser 228 is manufactured by Cole-Parmer Instrument Co., Chicago, Ill., Model No. 7529-20. The ink dispenser 228 uses an air pressure actuated switch/gauge assembly 233 for automatically controlling the activation of the ink pump 229. This type of switch 233 is also commercially available and the preferred assembly used in the present ink dispenser is manufactured by Dwyer Instruments, Inc., Michigan City, Ind., photohelic (registered trademark) pressure switch/gauge Model No. 3002.

The hose 230 transports printing ink from a reservoir 231 through the pump 229 and into a bore hole 232 formed through the length of the squeegee support beam 198. The lower circumference of the bore hole 232 passes outside the support beam 198 to form a slot 236 running the entire length of the bore hole 232. The bore hole 232 is dimensioned to receive the ink hose 230 and allow the ink dispensing end 237 of the hose 230 to be positioned at any point along the length of the squeegee support beam 198. The hose 230 is preferably stepped down from approximately half an inch to a quarter of an inch for fitting into the hole 132. The copy or image making area of stencils are often found at different points along the length of the stencil 132, depending upon the particular printing job. It is important for ink to be dispensed at the copy area of the stencil 132. The slotted bore hole 232 enables the ink dispensing end 237 of the hose 230 to be positioned wherever the copy area of the stencil 132 is located.

A source of pressurized air is connected by an approximately one-sixteenth of an inch air line hose 238 through the air pressure actuated switch 233 and to an air line bore hole 239 formed lengthwise through the squeegee support beam 198 below the channel 199. An exit line 240, forming an obtuse angle of approximately 135° with the bore hole 239, exits the beam 198 about halfway along the length oft he beam 198, connecting the space 241 directly under the squeegee 43 to the switch 233.

Ink supplied to the stencil 132 tends to congregate or roll up in this space 241 while the screen cylinder is rotating (i.e., in operation). Line 238 is pressurized through switch 233 with a very low pressure of approximately 2–3 inches of water, possibly as high as 6 inches of water for higher viscosity inks. For example, 4–6" of water for 700–900 centipoise of fluid viscosity. The ink in space 241 is adjacent to the opening to the exit line 240. The size of space 241 changes directly as the amount of ink in the screen cylinder 35 changes. When the space 241 filled with ink covers the exit line 240, air pressure builds up in the line 238 and the switch 233 turns off the pump 229. As ink is used up, the space 241 decreases until air begins to come out of the exit line 240. As this occurs, the pressure in the line 238 drops until the switch 233 turns the pump 229 back on and ink is pumped into the screen cylinder 35. When the ink builds up again, the switch 233 turns the pump 229 off and the cycle is repeated as often as necessary until the printing run is over.

Figure 11:
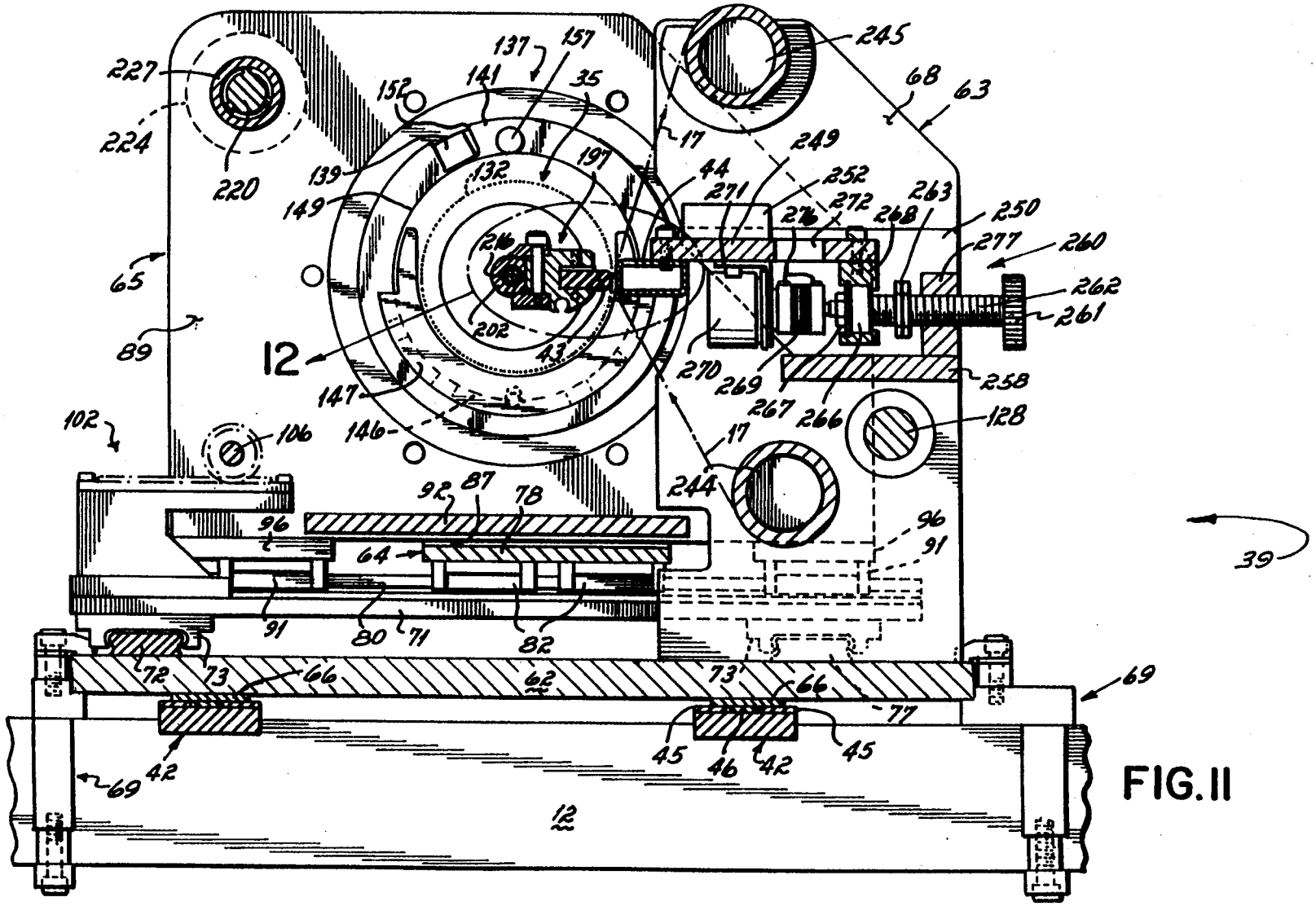
FIG. 11 is a diagrammatic cross-sectional view taken along the line 11—11 of FIG. 5.
Figure 12:
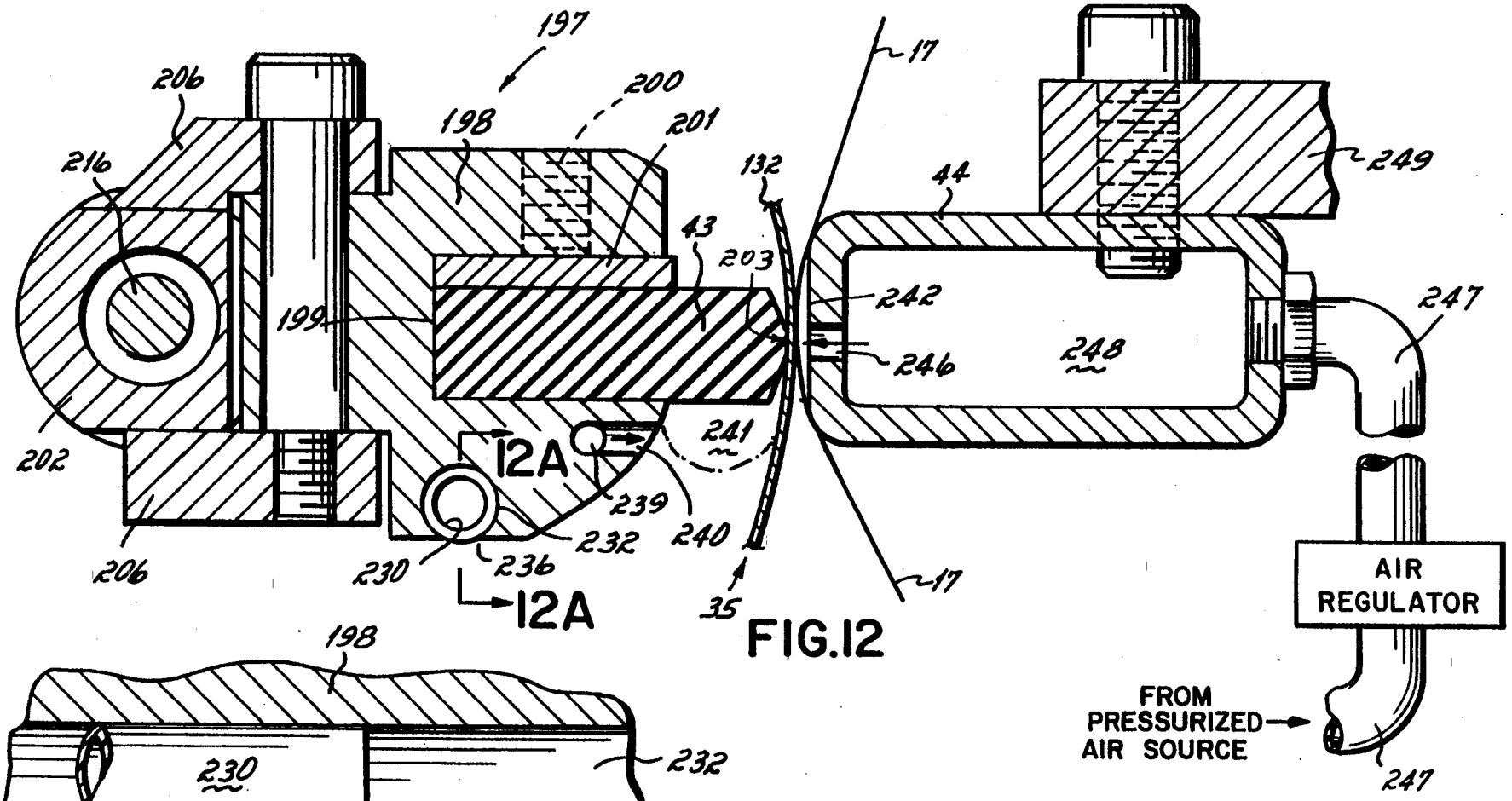
FIG. 12 is a greatly magnified schematic view of the encircled area of FIG. 11.
Figure 12A:
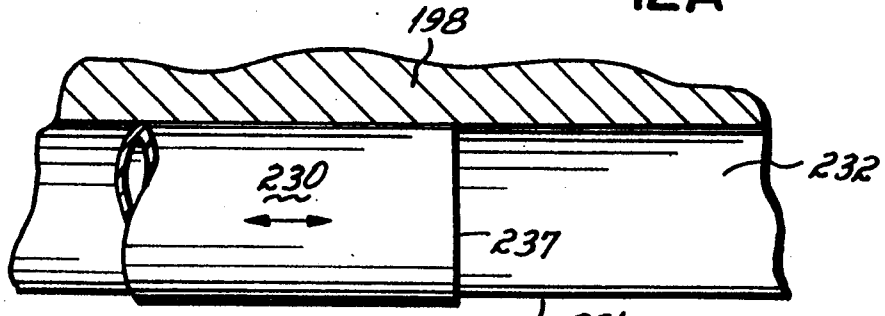
FIG. 12A is an enlarged diagrammatic view taken along the line 12A—12A of FIG. 12.
Figure 13:
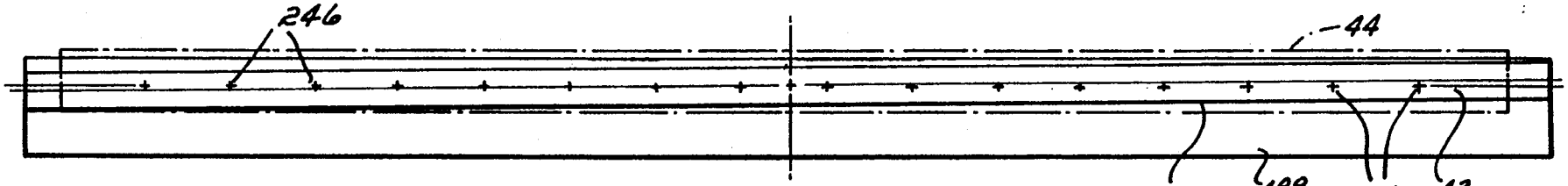
FIG. 13 is a schematic view taken generally along the line 13—13 of FIG. 6 illustrating the angular or skewed relationship of the squeegee blade with respect to the impression bar.

Referring to FIGS. 6, 11, and 12, rather than using an impression cylinder roller 26, like that conventionally used in a variety of rotary printing presses, to back the continuous web 17 during the image transfer process, the rotary screen print head module 39 of the present invention utilizes a non-rotatable impression bar 44 to back the continuous web substrate 17. The web 17 is directed to and from the impression bar 44 by two idler rollers 244, 245. The lower idler roller 244 directs the movement of the continuous web 17 toward the impression bar 44 at an acute angle from the surface of the backing face 242. The upper idler roller 245 directs the movement of the continuous web 17 away from the impression bar 44 also at an acute angle from the surface of the backing face 242. Preferably, these acute angles should be at least 20°. In its preferred form, the impression bar 44 is a rectangular tube with its ends sealed. The impression bar 44 has a backing 242 with a plurality of co-linear air outlet ports 246 formed through the backing face 242 lengthwise along the impression bar 44. The outlet ports 246 are preferably spaced at about 1" intervals from either end of the impression bar 44 (see FIG. 13). Preferably, the horizontal plane passing through the central axis of the screen cylinder 35 is about ⅛ of an inch above the center lines of the air holes 246. In addition, the central longitudinal axis of the leading edge 203 of the squeegee blade 43 is preferably skewed across the backing face 242 of the impression bar 44 as shown in FIG. 13. Satisfactory results have been obtained with an impression bar 44 made of 11 gauge steel rectangular tubing measuring about 17" long, about 1.5" deep, and about 0.75" tall, having about 0.0625" (1/16") diameter outlet ports 246 with the centerline of the outline ports being about 0.0625" below the axial centerline of the backing face 242. The squeegee blade 43 is about ⅜ of an inch thick with its contacting edge 203 having a width of about 0.031". About 0.375" of the squeegee blade 43 extends out from the squeegee support beam 198. An air line 247 from a regulated source of pressurized air communicates with the hollow cavity 248 of the impression bar 44 to force pressurized air through the outlet ports 246 to form a cushion of air between the backing face 242 and the continuous web 17 being routed through the screen module 39 between the screen cylinder 35 and the impression bar 44 (i.e., a cushion of air is formed for the web 17 to ride on as it passes over the backing face 242 of the impression bar 44). The impression bar 44 is mounted between the two fixed vertical panels 67, 68, with its longitudinal centerline being generally co-planar with the central axis of the screen cylinder 35.

Referring to FIGS. 5, 6, and 11, the impression bar 44 is bolted to the underside of a support top plate 249. The support top plate 249 is suspended between a gear train side vertical guide support 250 and an operator side guide support 251. Two brass guide blocks 252, 253 mounted to the top plate 249 slidably interact with steel guide plates 256, 257 mounted on top of the two vertical guide supports 250, 251, respectively. Each steel guide plate 256, 257 extends medially inward and is slidably received by a bearing channel formed along a side of the respective brass guide block 252, 253. The vertical guide supports 250, 251 are mounted on top of a support table 258 which is suspended between the two fixed vertical panels 67, 68. The operator side of the support table 258 is bolted directly to the side of the operator side fixed vertical panel 67. However, because of an interference problem with the jack shaft main drive gear 129, a standoff block 259, mounted between the gear train side vertical guide support 250 and fixed vertical panel 68, is used to support the gear train side of the support table 258. Thus, the impression bar 44 is moveable in a generally horizontal plane by slidably interacting the brass guide blocks 252, 253 and steel guide plates 256, 257. Dual micrometer adjustment mechanisms 260 are mounted between the support top plate 249 and the support table 258 for making fine adjustments of the position of the impression bar 44 within its horizontal plane of motion relative to the surface of the screen cylinder 35. Thus, the relative position of the impression bar 44 can be adjusted, for example, to accommodate varying thicknesses in the web substrate 17 being processed, as well as insuring that the web 17 and stencil 132 maintain adequate contact to insure proper transfer of the inked image to the web substrate 17.

Each micrometer adjustment mechanism 260 includes a manual adjustment knob 261 mounting a threaded shaft 262 for adjusting the position of the impression bar 44 relative tot he stencil 132. Jam nuts 263 are threadably disposed along the length of the threaded shaft 262. These nuts 263 are set so as to provide a preset zero point: for zeroing the adjustment mechanism 260. Preferably the zero point positions the impression 44 about one quarter of an inch parallel from the stencil 132. A spherical bearing 266 is locked onto the threaded shaft 262 by a lock nut 267. The spherical bearing 266 is housed within a bearing block 268 which is mounted to the underside of the support top plate 249. A flexible shaft coupling 269 connects the end of the threaded shaft 262 to an encoder 270. The encoder is connected to a position indicating digital counter (not shown). The encoder 270 is mounted to the underside of the support top plate 249 by a mounting bracket 271. The threaded shaft 262 is received by a threaded hole formed through an adjustment block 277 which is mounted to the top surface of the support table 258, which is fixed. Windows 272 are formed through the support top plate 249 above each flexible shaft coupling 269 to provide access to set screws 276 used to clamp the coupling 269 to respective shafts of the threaded shaft 262 and encoder 270. Pulses generated by the encoder 270 are digitally displayed for a printing press operator. The pitch of the threads of the threaded shaft 262 are directly related to the pulses per revolution generated by the encoder 270. Preferably, the encoder 270 has a sensitivity of about 250 pulses per revolution for coupling to a threaded shaft 262 having 40 pitch threads.

Installation of the screen print head module 39 adjacent to the down line flexographic print head 40 is accomplished as previously described. During installation, before the bottom base plate 62 is clamped to the tie bars 12, lateral and longitudinal positioning of the screen module 39 is determined by the alignment and engagement between the jack shaft main drive gear 129 and the planetary gear 49 of the swing gear assembly 47. The screen cylinder 35 is not mounted in the module 39 prior to initial installation because it is easier to initially feed the web 17 through the module 39 with the screen cylinder 35 removed. Once the web 17 has been fed through the screen module 39, the ends of the screen cylinder 35 are placed in the retaining mechanisms 136, 137 through the top of the module 39, and the end rings 135 of the screen cylinder 35 locked in place as previously described.

To insert the squeegee mounting mechanism 197, the squeegee support plates 86, 87 and cross plate 78 should be unhooked from the squeegee adjustment mechanism 107 by unlocking the hooking arm 118, to allow the squeegee support plates 86, 87 and cross plate 78 to be freely moved longitudinally. The splined mounting shaft 220 should then be pulled laterally out of its bearing inserts 224, the loading arm 219 swung to the loading position and the squeegee cylinder dove tail 207 clamped to the end of the loading arm 219, with the counter bore end 208 of the squeegee tube 202 being unsupported and pointing toward the gear side of the screen module 39. The splined mounting shaft 220 is then pushed back into the module housing 61 until the squeegee tube dove tail 207 slides through the squeegee tube clamp 209 and the counter bore end 208 of the squeegee tube 202 mates with the flanged end nut 212 mounted on the gear side squeegee support plate 87. The squeegee loading arm 219 is then unclamped from and backed off of the dove tail 207 and then swung into the standby position. The threaded rod 16 is then threaded into the flanged end nut 212 and tightened until the squeegee tube 202 is secured to the gear side squeegee support plate 87. The dove tail clamp 209 is then tightened to clamp the squeegee tube dove tail 207 to the operator side squeegee support plate 86.

With the air cylinder 108 deactivated, the squeegee support plates 86, 87 and cross plate 78 are hooked up to the squeegee position adjustment mechanism 107 as previously described. The hooking arm 118 should be positioned on the sir cylinder stroke shaft 115 such that the squeegee blade 43 does not make contact with the stencil 132 when this hook up is made. The air line 238 and ink supply tube 230 from the automatic ink dispenser unit 228 are then connected to the squeegee support beam 198. The air cylinder 108 is then activated with the threaded adjustable stop mechanism 109 set such that the squeegee blade 43 applies light pressure to or does not quite make contact with the stencil 132. Preferably, fifty psi of air pressure is supplied to the air cylinder 108 of the squeegee position adjustment mechanism 107.

The printing press 10 is then turned on, feeding the web 17 through the screen module 39, and the ink dispenser unit 228 activated to supply ink to the screen cylinder 35. The impression bar 44, with the web 17 being backed thereon, is initially separated from the stencil 132. At this time the operator makes a number of adjustments to obtain a desired image quality. The operator first manipulates the threaded adjustable stop 109 and impression bar adjustment mechanism 260, at the same time, to make fine adjustments of the positions of each relative to the stencil 132. While circumferential registration of the printed images is controlled by the existing registration system of the flexographic print head 40, lateral registration is controlled by the lateral adjustment mechanism 97 which controls the lateral position of the middle bearing plate 71 and therefore the screen cylinder 35.

To replace the screen cylinder 35 or partially retrofit another flexographic print head 18 with the screen module 39, the preceding procedure is basically reversed back to the desired step.

While this invention has been described with reference to only one preferred embodiment, persons skilled in the art to which this invention pertains will appreciate numerous changes and modifications which may be made without departing from the spirit of this invention. Therefore, it is intended that the invention not be limited to the particular embodiment disclosed, but that the invention will include all embodiments failing within the scope of the following appended claims.

What is claimed is:

1. A print head module, dedicated to one type of printing, for functionally replacing one print head of a printing station, dedicated to another type of printing, in a rotary printing press having a plurality of spaced apart print head stations for transferring multiple images along the length of a continuous web substrate, said print head module comprising:

a housing mountable adjacent to at least one of the print head stations of the rotary printing press;

printing means having a rotatable element mounted for rotation within said housing for transferring an image onto the continuous web;

rotating means for rotating the rotatable element of said printing means;

supply; means for supplying a transferable image forming fluid to said printing means;

impression means carried by said housing, said impression means having a backing face for backing the continuous web while an image is being transferred thereon;

web directing means carried by said housing for directing the path of the continuous web through said housing and between said printing means and said impression means;

positioning means for enabling the relative positions of said printing means and said impression means to be adjusted such that said backing face backs the continuous web while an image is being transferred thereon; and, means for connecting said print head module to said one print head such that said print head module functionally replaces said one print head and such that at least one drive gear of said one print head is used to drive said rotating means of said print head module.

2. The print head module of claim 1 wherein said rotating means includes a gear system and an intermediate gear box which drivingly interconnects the gear system of said rotary print head module with at least one drive gear of the functionally replaced print head.

3. The print head module of claim 2 wherein said intermediate gear box is a separate swing gear assembly having a planetary gear engaged with and rotatable about an idler gear, wherein said idler gear is positionable for continuous driving engagement with at least one drive gear of the functionally replaced print head and said swing gear assembly includes means for rotating said planetary gear in and out of engagement with the gear system of said print head module.

4. The print head module of claim 1 wherein said impression means includes a non-rotating impression bar having a backing face and means for forming an air cushion between said backing face and the continuous web.

5. The print head module of claim 4 wherein said air cushion forming means includes a plurality of air outlet holes formed through the backing face of said impression bar for communicating with a source of pressurized air.

6. The print head module of claim 4 wherein said web directing means includes two idler rollers, one of said idler rollers being mounted for directing the movement of the continuous web toward said impression bar at an acute angle from the surface of said backing face and the other of said idler rollers being mounted for directing the movement of the continuous web away from said impression bar at an acute angle from the surface of said backing face.

7. The print head module of claim 4 wherein the rotatable element of said printing means includes a tubular stencil having an inside surface and said printing means includes a squeegee blade mountable radially against the inside surface of said tubular stencil.

8. The print head module of claim 7 wherein said housing includes a first frame for mounting said impression bar, a second frame for mounting said squeegee blade and a third frame for mounting said tubular stencil, said frames being interconnected, with said second frame and said third frame being slidable relative to one another and said first frame, wherein said squeegee blade and said tubular stencil are moveable toward and away from one another and said impression bar.

9. The print head module of claim 8 wherein said positioning means includes at least one microadjustment mechanism mounted to said first frame for adjusting the position of said impression bar relative to the rotatable element of said printing means.

10. The print head module of claim 8 wherein said positioning means includes a squeegee position adjustment mechanism mounted to said second frame for adjusting the position of said squeegee blade relative to said tubular stencil.

11. The print head module of claim 7 wherein said squeegee blade has a leading edge, the backing face of said non-rotating impression bar and the leading edge of said squeegee blade each have a central longitudinal axis, and the leading edge of said squeegee blade is mounted radially against the inside surface of said tubular stencil such that the central longitudinal axis of the leading edge of said squeegee blade is skewed from the central longitudinal axis of the backing face of said non-rotating impression bar.

12. The print head module of claim 11 wherein the central longitudinal axis of the leading edge of said squeegee blade is skewed at an angle of approximately 0.5° from the central longitudinal axis of the backing face of said non-rotating impression bar.

13. The print head module of claim 12 wherein a bevel is formed along the top and along the bottom of the leading edge of said squeegee blade thereby forming a double bevel profile, said double bevel profile is generally symmetrical, with each bevel formed at an angle of about 25° from said leading edge.

14. The print head module of claim 1 wherein said printing means includes a screen cylinder having a tubular stencil with an inside surface, a mounting ring fixed at each end of said tubular stencil, and a squeegee blade mountable in said housing radially against the inside surface of said tubular stencil, and said print head module includes two retaining mechanisms, each of said retaining mechanisms retaining one of said mounting rings, at least one of said retaining mechanisms having means for securing one of said mounting rings therewithin and thereby preventing the rotation of said screen cylinder within said retaining mechanisms, each of said retaining mechanisms being mounted for rotation within said housing, and said rotating means rotating both of said retaining mechanisms and thereby said screen cylinder.

15. The print head module of claim 14 wherein said rotating means includes at least one gear mounted to at least one of said retaining mechanisms for being driven by a drive gear train in the rotary printing press, both of said retaining mechanisms being thereby rotated simultaneously.

16. The print head module of claim 14 wherein each of the mounting rings of said screen cylinder has a circular flange, and each of said retaining mechanisms includes a retaining well for receiving the flange of one of said mounting rings and a locking ring rotatable between an unlocked open position in which said flange can be removed from said retaining well and a locked and closed position in which said flange is fixed within said retaining well.

17. The print head module of claim 1 wherein said printing means includes a tubular stencil having an inside surface and a squeegee blade mountable radially against the inside surface of said tubular stencil, said print head module includes a screen tensioning mechanism having adjustment means for applying a variable tension load to said tubular stencil and means for determining the tension load applied to said tubular stencil.

18. The print head module of claim 17 wherein said housing has opposite side walls, and said adjustment means includes two bearing assemblies, and means for moving at least one bearing assembly relative to the other bearing assembly, each of said bearing assemblies being mounted on opposite sides of said housing with said tubular stencil being mounted for rotation between said bearing assemblies, said tubular stencil has a longitudinal axis, and a variable tension load may be applied to said tubular stencil by moving said at least one bearing assembly with said means for moving in a direction along the longitudinal axis of said tubular stencil away from said other bearing assembly.

19. The print head module of claim 18 wherein the means for determining the tension load applied to said tubular stencil includes at least one load cell mounted for measuring the tension applied to said tubular stencil.

20. The print head of claim 19 wherein one of said bearing assemblies is an adjustable bearing assembly, and the other of said bearing assemblies is a fixed bearing assembly, said adjustable bearing assembly is movable in a direction along the longitudinal axis of said tubular stencil away from said fixed bearing assembly by said means for moving, said load cell is a transducer sensitive to compressive loads, and said load cell being mounted between said adjustable bearing assembly and the housing side wall mounting said adjustable bearing assembly.

21. The print head module of claim 17 wherein said screen tensioning mechanism further includes means for monitoring the tension load applied to said tubular stencil.

22. A print head in a rotary printing press for transferring multiple images along the length of a continuous web substrate, said print head comprising:

a housing;

printing means having a rotatable element mounted for rotation within said housing for transferring an image onto the continuous web;

rotating means for rotating the rotatable element of said printing means;

supply means for supplying a transferrable image forming fluid to said printing means;

impression means carried by said housing, said impression means including a non-rotating impression bar having a backing face and means for forming an air cushion between said backing face and the continuous web;

web directing means carried by said housing for directing the path of the continuous web through said housing and between the rotatable element of said printing means and the non-rotating impression bar of said impression means, and positioning means for enabling the relative positions of said printing means and said impression bar to be adjusted such that said backing face backs the continuous web while an image is being transferred onto the continuous web.

23. The print head of claim 22 wherein said air cushion forming means includes a plurality of air outlet holes formed through the backing face of said impression bar for communicating with a source of pressurized air.

24. The print head of claim 22 wherein the rotatable element of said printing means includes a tubular stencil having an inside surface and said printing means includes a squeegee blade mountable radially against the inside surface of said stencil.

25. The print head of claim 24 wherein said squeegee blade has a leading edge, the backing face of said non-rotating impression bar and the leading edge of said squeegee blade each have a central longitudinal axis, and said squeegee blade is mounted radially against the inside surface of said tubular stencil such that the central longitudinal axis of the leading edge of said squeegee blade is skewed from the central longitudinal axis of the backing face of said non-rotating impression bar.

26. The print head of claim 25 wherein the central longitudinal axis of the leading edge of said squeegee blade is skewed at an angle of approximately 0.5° from the central longitudinal axis of the backing face of said non-rotating impression bar.

27. The print head of claim 26 wherein a bevel is formed along the top and along the bottom of the leading edge of said squeegee blade thereby forming a double bevel profile, said double bevel profile is generally symmetrical, with each bevel formed at an angle of about 25° from said leading edge.

28. A print head in a rotary screen printing press for transferring multiple images along the length of a continuous web substrate, said print head comprising:

a housing;

a screen cylinder having a tubular stencil with an inside surface, opposite ends and a mounting ring fixed at each end of said tubular stencil, said tubular stencil having at least or e copy area for transferring an image onto the continuous web as said screen cylinder is rotated and each mounting ring including a flange.;

two retaining mechanisms, each of said retaining mechanisms retaining one of said mounting rings, at least one of said retaining mechanisms including a retaining well for receiving the flange of one of said mounting rings therewithin and thereby preventing the rotation of said screen cylinder within said retaining mechanisms, said at least one retaining mechanism further including a locking mechanism movable between an unlocked open position in which said flange may be removed from said retaining well and a locked and closed position in which said flange is fixed within said retaining well, each of said retaining mechanisms being mounted for rotation within said housing;

rotating means for rotating both of said retaining mechanisms and thereby said screen cylinder;

supply means for supplying a transferrable image forming fluid to the copy area of said tubular stencil;

impression means carried by said housing, said impression mechanism having a backing face for backing the continuous web while an image is being transferred thereon;

web directing means carried by said housing for directing the path of the continuous web between said screen cylinder and said impression mechanism; and positioning means for enabling the relative positions of said screen cylinder and said impression means to be adjusted such that said backing face backs the continuous web while an image is being transferred onto the continuous web.

29. The print head of claim 28 wherein said rotating means includes at least one gear mounted to at least one of said retaining mechanisms for being driven by a drive gear train in the rotary printing press, both of said retaining mechanisms being thereby rotated simultaneously.

30. The print head of claim 28 wherein each of the mounting rings of said screen cylinder has a circular flange, each of said retaining mechanisms includes a retaining well for receiving the flange of one of said mounting rings and a locking mechanism is provided with each retaining mechanism, each said locking mechanism including a locking ring rotatable between said unlocked opened position and said locked and closed position.

31. A print head in a rotary screen printing press for transferring multiple images along the length of a continuous web substrate, said print head comprising:

a housing;

printing means including a tubular stencil having an inside surface and mounted for rotation within said housing and a squeegee blade mountable radially against the inside surface of said tubular stencil, said printing means being carded by said housing for transferring an image onto the continuous web as said tubular stencil rotates;

rotating means for rotating said tubular stencil;

supply means for supplying a transferable image forming fluid to at least one copy area on said tubular stencil;

impression means carried by said housing, said impression means having a backing face for backing the continuous web while an image is being transferred thereon from said tubular stencil;

web directing means carried by said housing for directing the path of the continuous web between said tubular stencil and said impression means;

positioning means for enabling the relative positions of said tubular stencil and said impression means to be adjusted such that said backing face backs the continuous web while an image is being transferred thereon; and a screen tensioning mechanism having adjustment means for applying a variable tension load to said tubular stencil and means for determining the tension load applied to said tubular stencil.

32. The print head of claim 31 wherein said housing has opposite side walls, and said adjustment means includes two bearing assemblies, and means for moving at least one bearing assembly relative to the other bearing assembly, each of said bearing assemblies being mounted on opposite sides of said housing with said tubular stencil being mounted for rotation between said bearing assemblies, said tubular stencil has a longitudinal axis, and a variable tension load may be applied to said tubular stencil by moving said at least one bearing assembly with said means for moving in a direction along the longitudinal axis of said tubular stencil away from said other bearing assembly.

33. The print head of claim 32 wherein the means for determining the tension load applied to said tubular stencil includes at least one load cell mounted for measuring the tension applied to said tubular stencil.

34. The print head of claim 33 wherein one of said bearing assemblies is an adjustable bearing assembly, and the other of said bearing assemblies is a fixed bearing assembly, said adjustable bearing assembly is movable in a direction along the longitudinal axis of said tubular stencil away from said fixed bearing assembly by said means for moving, said load cell is a transducer sensitive to compressive loads, and said load cell is mounted between said adjustable bearing assembly and the housing side wall mounting said adjustable bearing assembly.

35. The print head of claim 31 wherein said screen tensioning mechanism further includes means for monitoring the tension load applied to said tubular stencil.

* * * * *

UNITED STATES PATENT AND TRADEMARK OFFICE

CERTIFICATE OF CORRECTION

PATENT NO. : 5,400,709

DATED : March 28, 1995

INVENTOR(S) : Drilling et al.

It is certified that error appears in the above-indentified patent and that said Letters Patent is hereby corrected as shown below:

Col. 4, line 59, after "Fig. 5" insert --is--.

Col. 16, line 54, "failing" should be --falling--.

Col. 17, line 3, "supply;" should be --supply--.

Col. 21, line 22, "carded" should be --carried--.

Col. 20, line 31, "on e" should be --one--.

Signed and Sealed this

Twelfth Day of September, 1995

*Attest:*

*Attesting Officer*

Bruce Lehman

BRUCE LEHMAN

*Commissioner of Patents and Trademarks*